US009121398B1

(12) United States Patent
Al-Nesafi

(10) Patent No.: US 9,121,398 B1
(45) Date of Patent: Sep. 1, 2015

(54) FLOAT-OPERATED PUMP SWITCH

(71) Applicant: Abdullah M. S. Al-Nesafi, Al Farwaniya (KW)

(72) Inventor: Abdullah M. S. Al-Nesafi, Al Farwaniya (KW)

( * ) Notice: Subject to any disclaimer, the term of this patent is extended or adjusted under 35 U.S.C. 154(b) by 0 days.

(21) Appl. No.: 14/673,791

(22) Filed: Mar. 30, 2015

(51) Int. Cl.
*F04B 23/02* (2006.01)
*F04D 15/02* (2006.01)
*F04B 49/02* (2006.01)

(52) U.S. Cl.
CPC ..... *F04B 23/02* (2013.01); *F04B 23/023* (2013.01); *F04B 49/02* (2013.01); *F04D 15/0218* (2013.01)

(58) Field of Classification Search
CPC ..... F04B 23/02; F04B 23/023; F04B 49/02; F04D 15/0218; H01H 35/18; G01F 23/30; G01F 23/32; G01F 23/34; G01F 23/40; G01F 23/56; C02F 2209/42
USPC ..... 417/36–40, 126, 130, 133; 73/1.31, 73/1.73
See application file for complete search history.

(56) References Cited

U.S. PATENT DOCUMENTS

| | | | | | |
|---|---|---|---|---|---|
| 1,744,550 | A * | 1/1930 | Janette | 417/40 |
| 1,765,698 | A * | 6/1930 | Persons | 417/412 |
| 3,739,405 | A | 6/1973 | Schmidt | |
| 4,065,226 | A * | 12/1977 | Campbell | 417/40 |
| 4,421,459 | A * | 12/1983 | Frey | 417/38 |
| 4,480,469 | A | 11/1984 | Tice | |
| 4,752,188 | A * | 6/1988 | Gurega | 417/40 |
| 5,417,239 | A * | 5/1995 | Ford | 137/571 |
| 5,655,888 | A * | 8/1997 | Yumoto | 417/132 |
| 6,254,351 | B1 * | 7/2001 | Culp | 417/40 |
| 6,461,114 | B1 * | 10/2002 | Lin | 417/40 |
| 7,004,728 | B2 * | 2/2006 | Soares | 417/63 |
| 2006/0275136 | A1 * | 12/2006 | Liu | 417/40 |
| 2012/0082571 | A1 * | 4/2012 | Filippi | 417/279 |

FOREIGN PATENT DOCUMENTS

| | | | | |
|---|---|---|---|---|
| WO | WO 9100765 | * | 1/1991 | B01D 17/025 |

OTHER PUBLICATIONS

Band et al., "Design of an Automatic Water Level Controller Using Mercury Float Switch," IOSR Journal of Electronics and Communication Engineering, vol. 9, Issue 2, Ver. II (Mar.-Apr. 2014).

* cited by examiner

*Primary Examiner* — Devon Kramer
*Assistant Examiner* — Patrick Hamo
(74) *Attorney, Agent, or Firm* — Richard C. Litman

(57) ABSTRACT

The float-operated pump switch provides float-operated pump switching for automatically maintaining the water level in a water tank supplied by a reservoir. The switch operates to start pumping water when the level in the upper tank is one-quarter of the volume of the tank, and continues pumping until the tank is full, thereby providing a hysteresis and reducing the number of times the pump needs to be operated.

8 Claims, 9 Drawing Sheets

FLOAT-OPERATED PUMP SWITCH

BACKGROUND OF THE INVENTION

1. Field of the Invention

The present invention relates generally to water supplies, and particularly to a float-operated pump switch for automatically maintaining a water level in an upper tank from a lower tank.

2. Description of the Related Art

Water tanks are often used in dwellings and the like. New water conservation initiatives provide incentive to find ways to manage tank levels while minimizing the number of fill pump operations.

Thus, a float-operated pump switch solving the aforementioned problems is desired.

SUMMARY OF THE INVENTION

The float-operated pump switch is for automatically maintaining a water level in an upper tank from a lower tank. The switch operates to start pumping water when the level in the upper tank is one-quarter of the volume of the tank, and continues pumping until the tank is full, thereby providing a hysteresis and reducing the number of times the pump needs to be operated.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
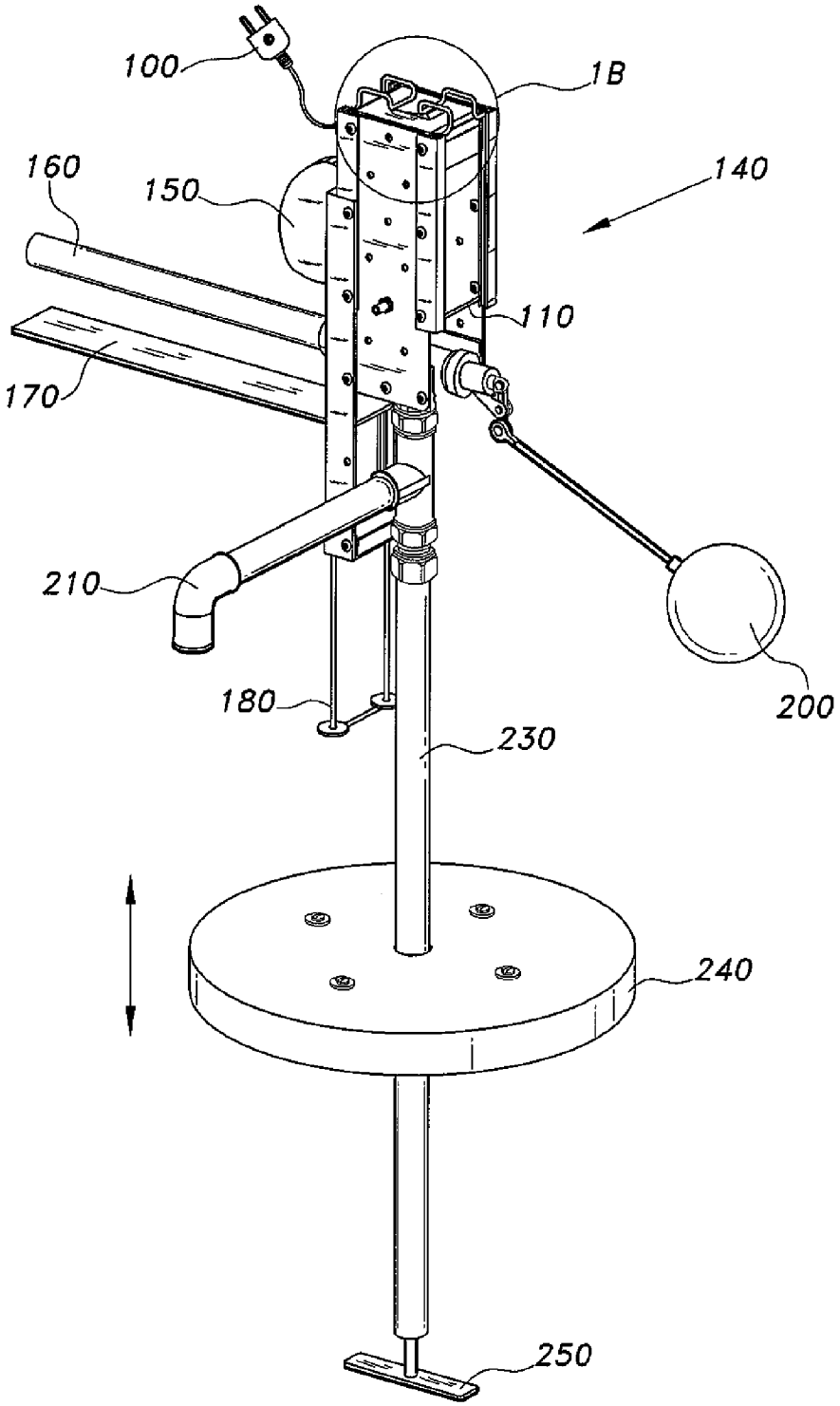
FIG. 1A is a perspective view of a float-operated pump switch according to the present invention as seen from the spigot side.
Figure 1B:
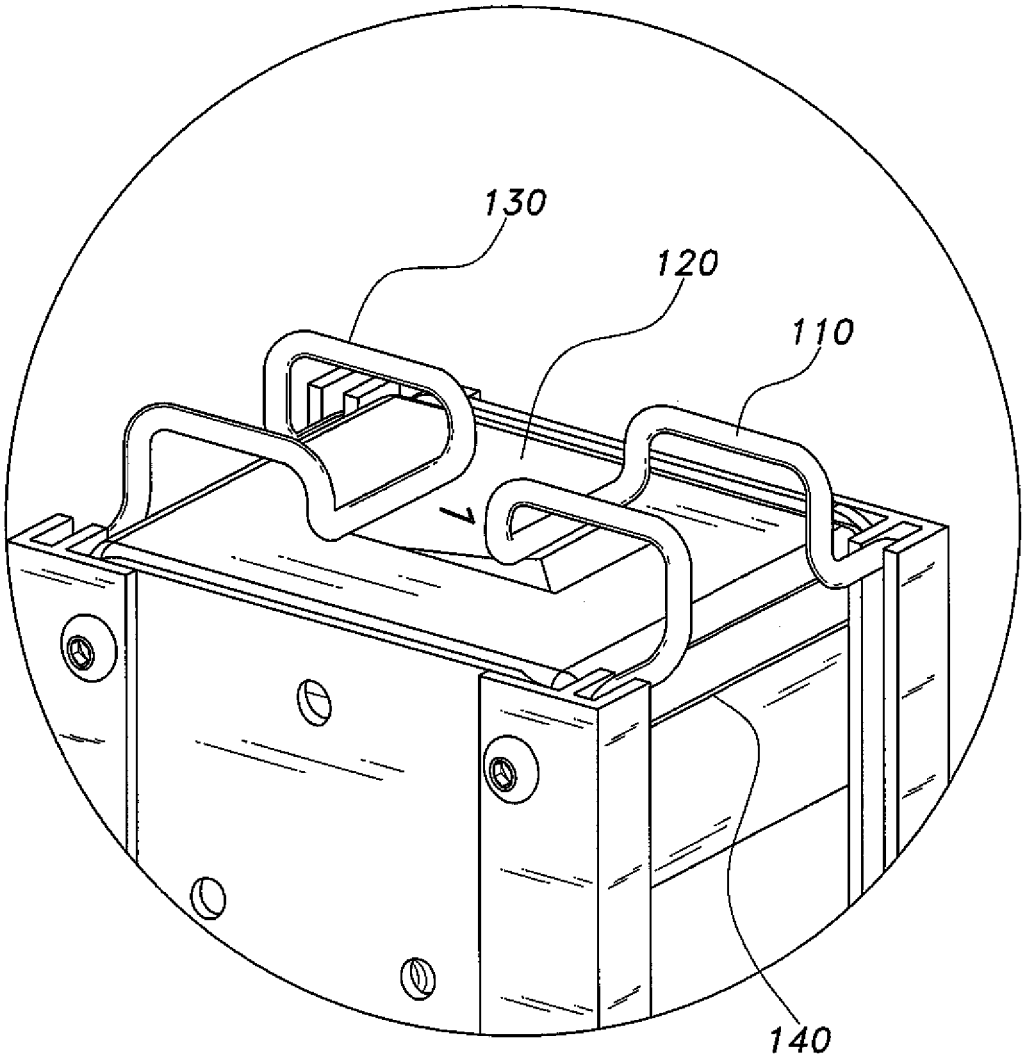
FIG. 1B is a detailed perspective view of area 1B of FIG. 1A.
Figure 2:
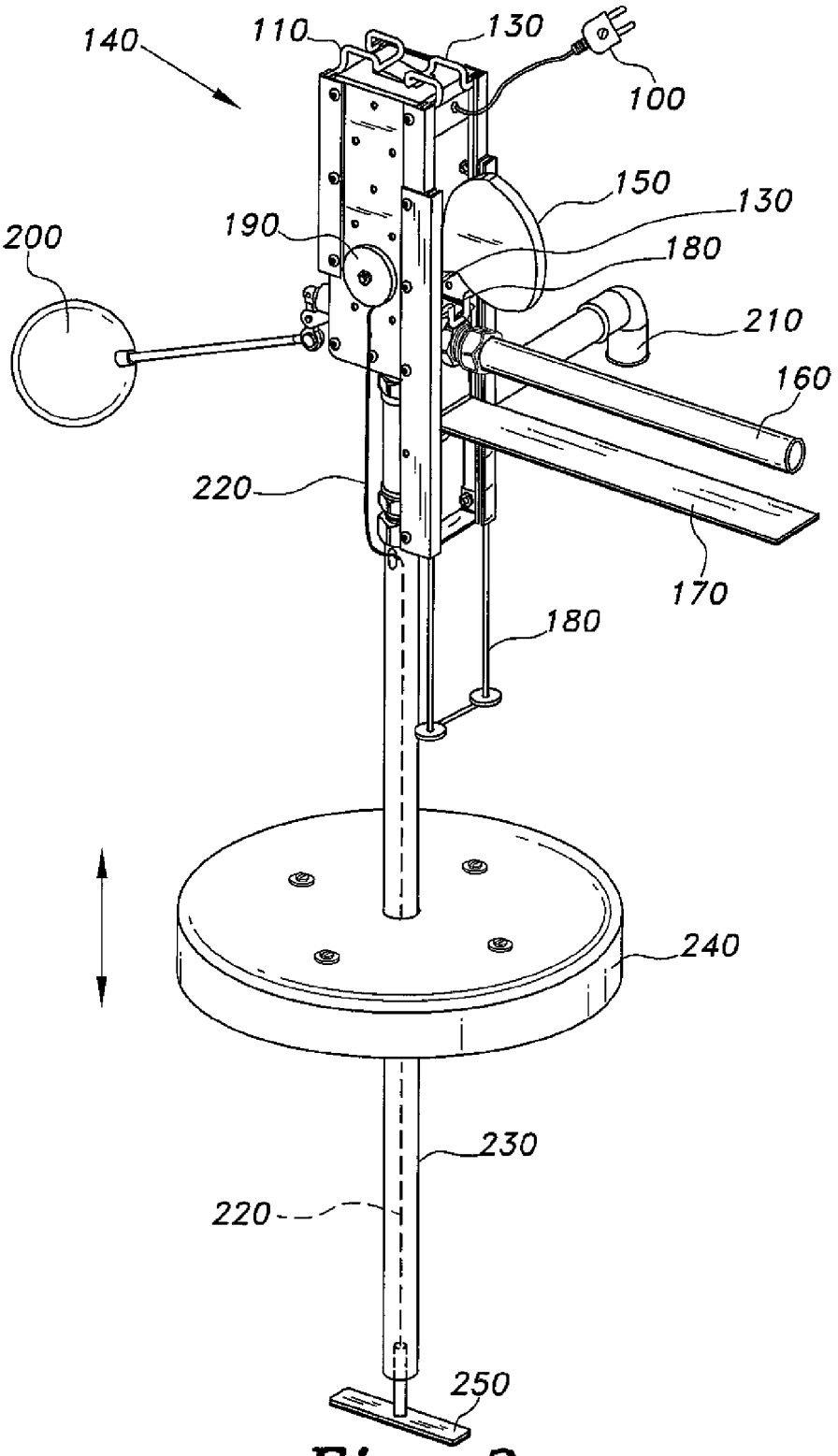
FIG. 2 is a perspective view of the float-operated pump switch of FIG. 1A as seen from the side opposite the spigot side.
Figure 8:
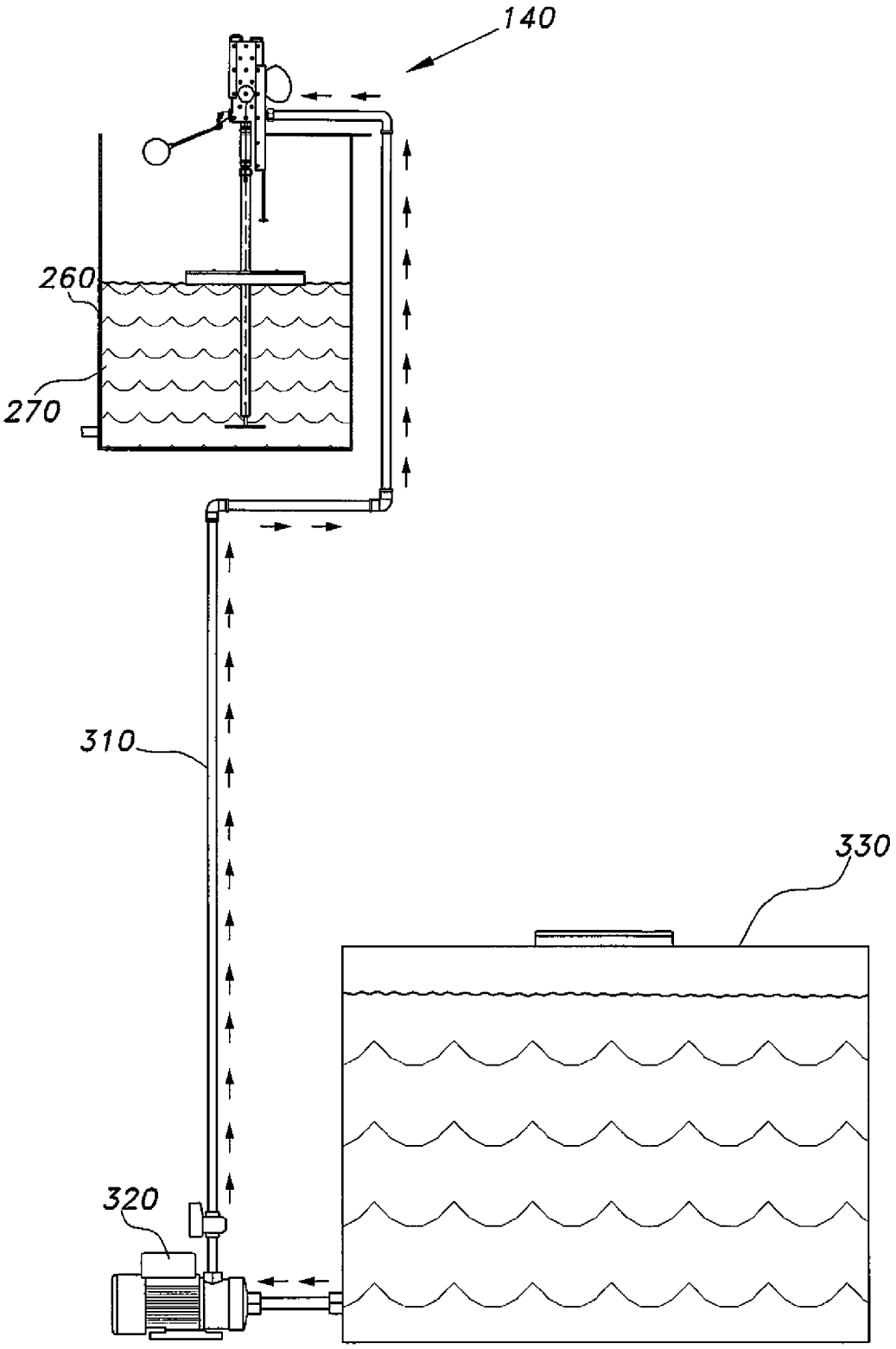
FIG. 8 is an environmental side view of the float-operated pump switch of FIG. 1A, showing the tank being filled from a reservoir.

The float-operated pump switch operates to start pumping water when the level in the upper tank is one-quarter of the volume of the tank, and continues pumping until the tank is full, thereby providing a hysteresis and reducing the number of times the pump needs to be operated. The device includes a power cable 100 (shown in FIG. 1A) connected to an electric water pump 320 (shown in FIG. 8) via a rocker power switch 120 (shown in FIG. 1B). When energized, the electric water pump 320 provides sufficient head to propel water from a lower tank 330 or reservoir to an upper tank 260 via a supply pipe 310. The supply pipe 310 is connected to a spigot 210 via an inlet pipe 160 (shown in FIG. 1A). The input pipe 160 includes an overflow float mechanism 200 that acts as a fail-safe mechanism should the primary float switch malfunction as the water level 270 is rising in the tank 260.

Figure 3:
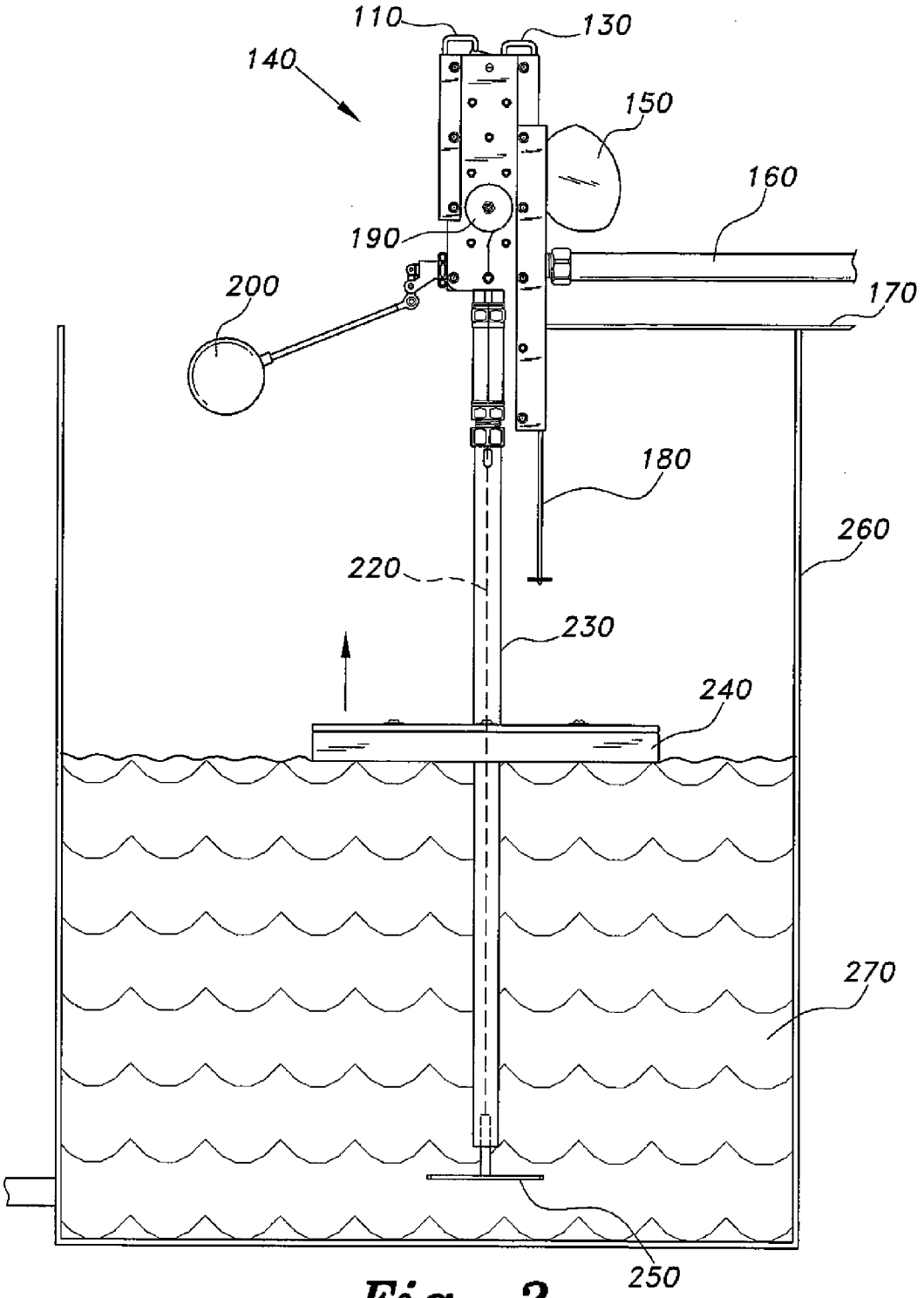
FIG. 3 is an environmental side view of the float-operated pump switch of FIG. 1A, shown disposed in a fluid tank with water at an intermediate level and with the pump configured for filling the tank.
Figure 4:
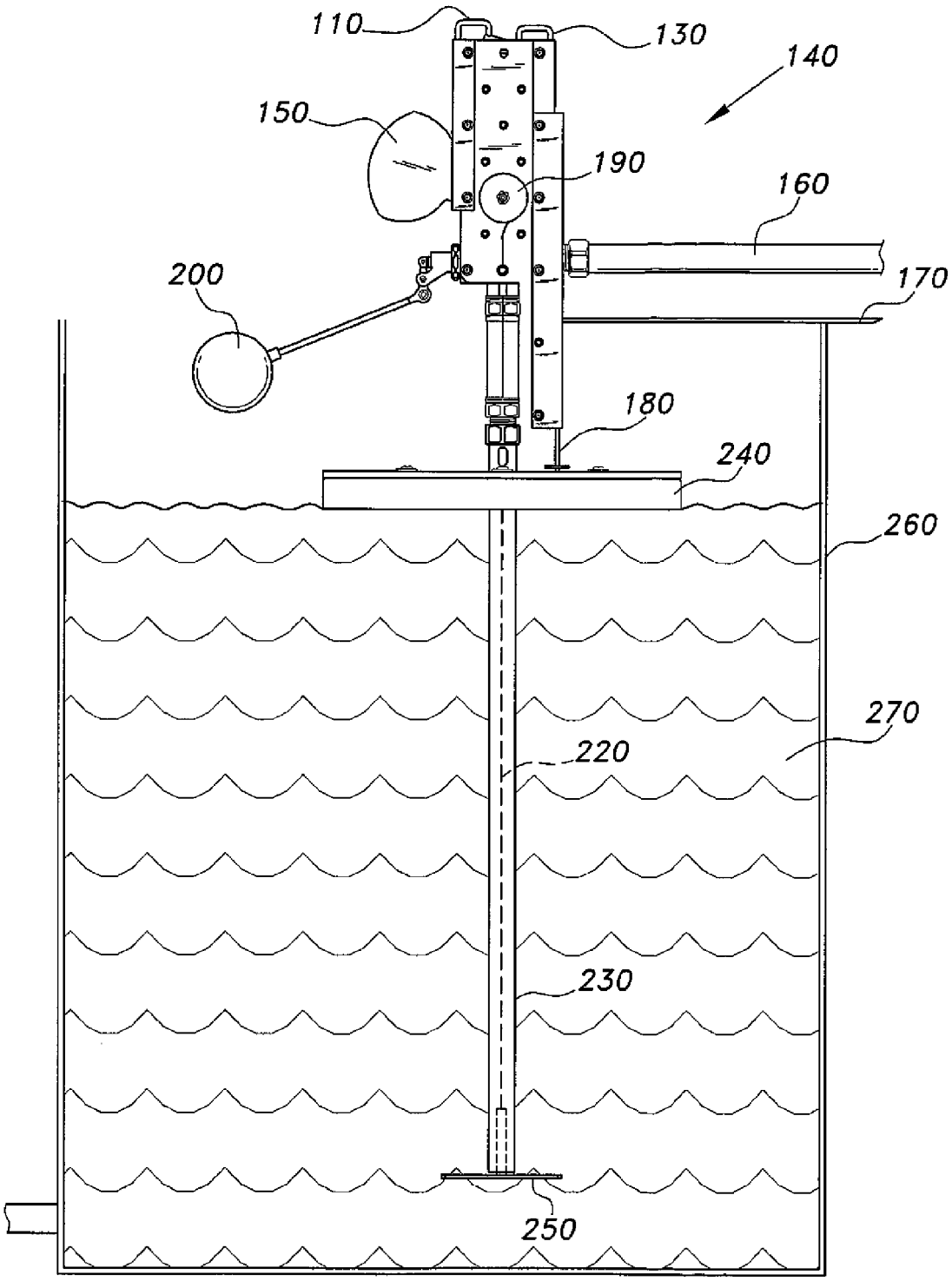
FIG. 4 is an environmental side view similar to FIG. 3, but showing the tank with a full water level and the pump in the shut off state.
Figure 5:
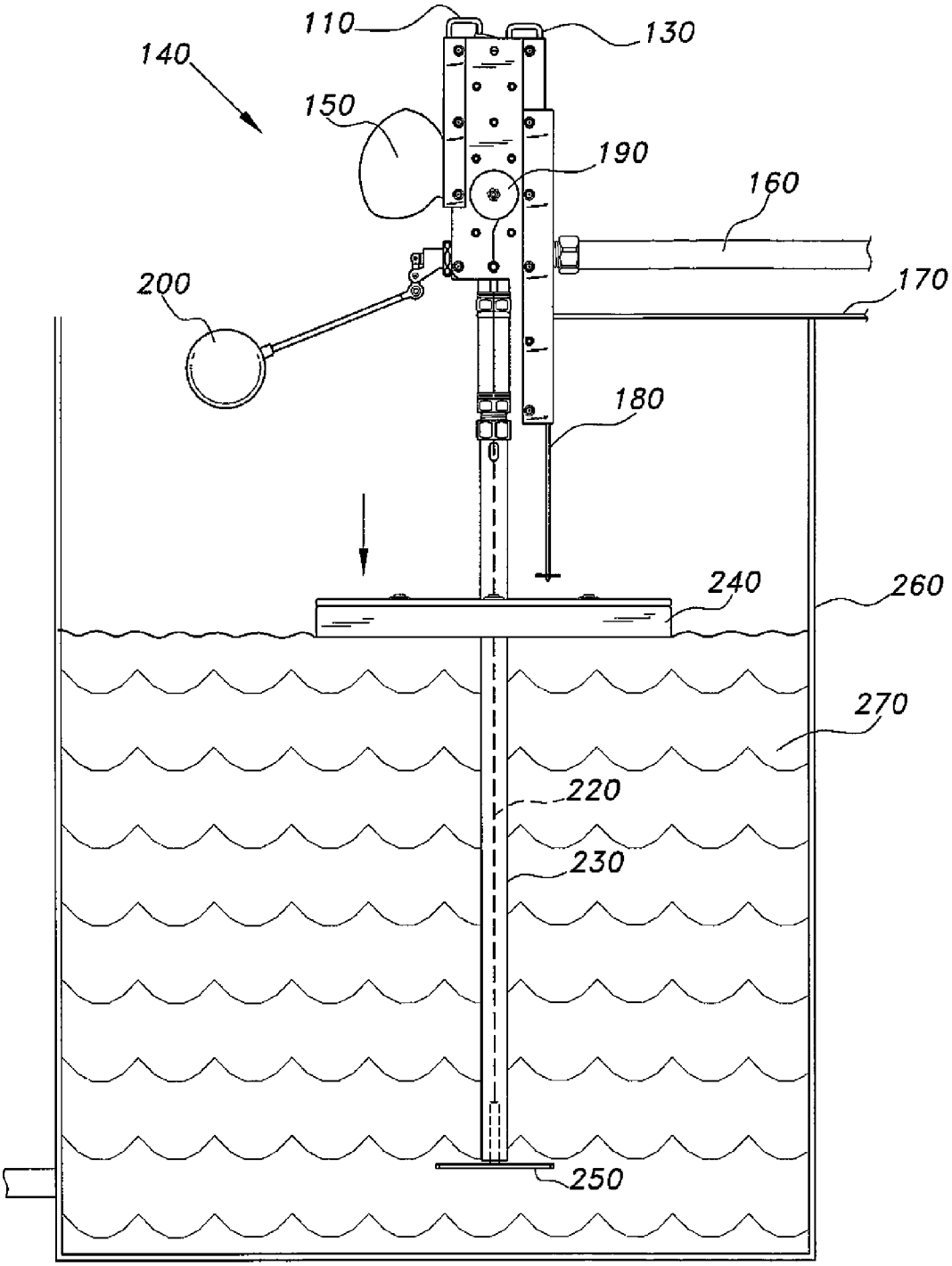
FIG. 5 is an environmental side view of the float-operated pump switch of FIG. 1A, showing the tank full and the float at rest.
Figure 6:
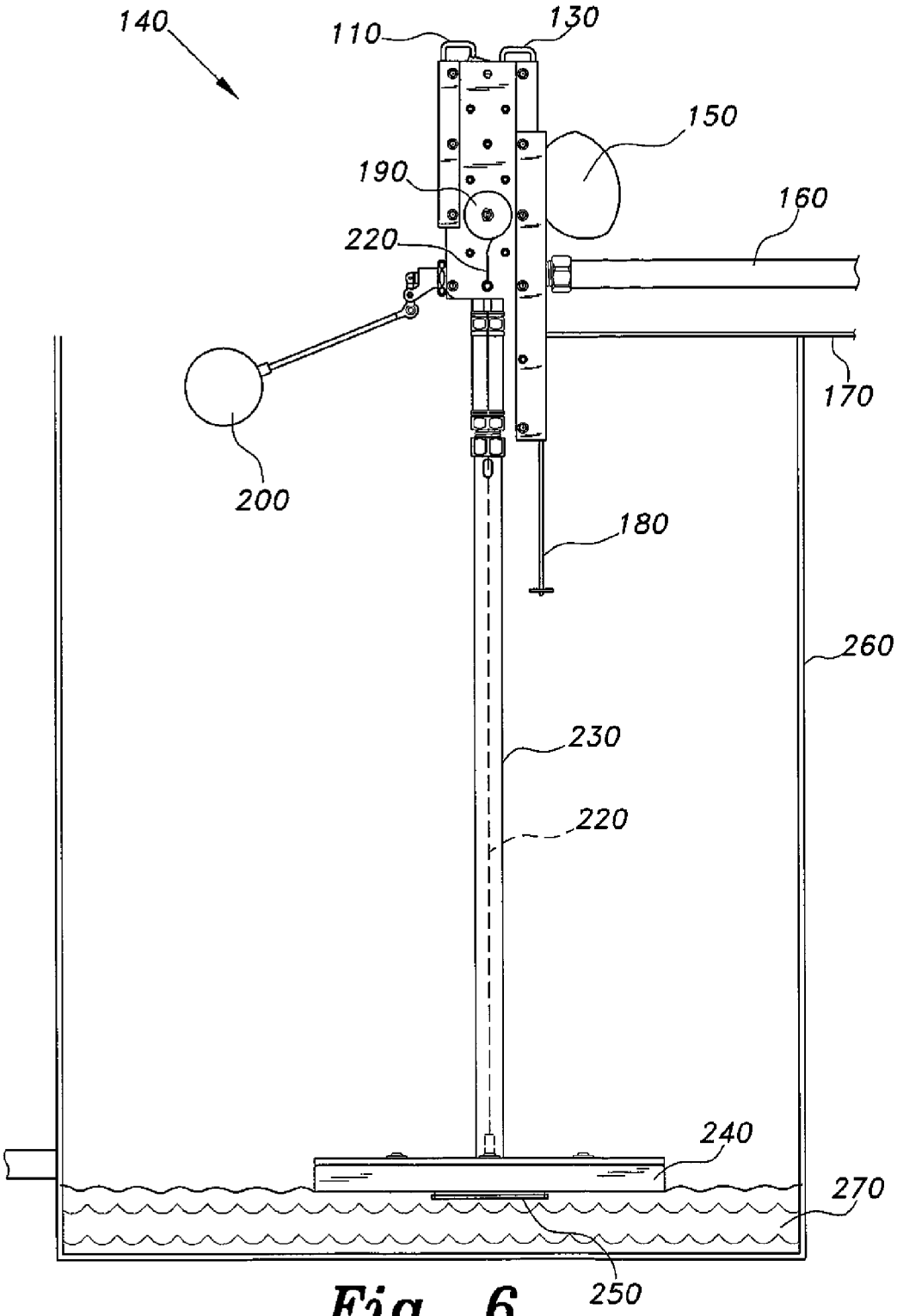
FIG. 6 is an environmental side view of the float-operated pump switch of FIG. 1A, showing the float at low fluid level.
Figure 7:
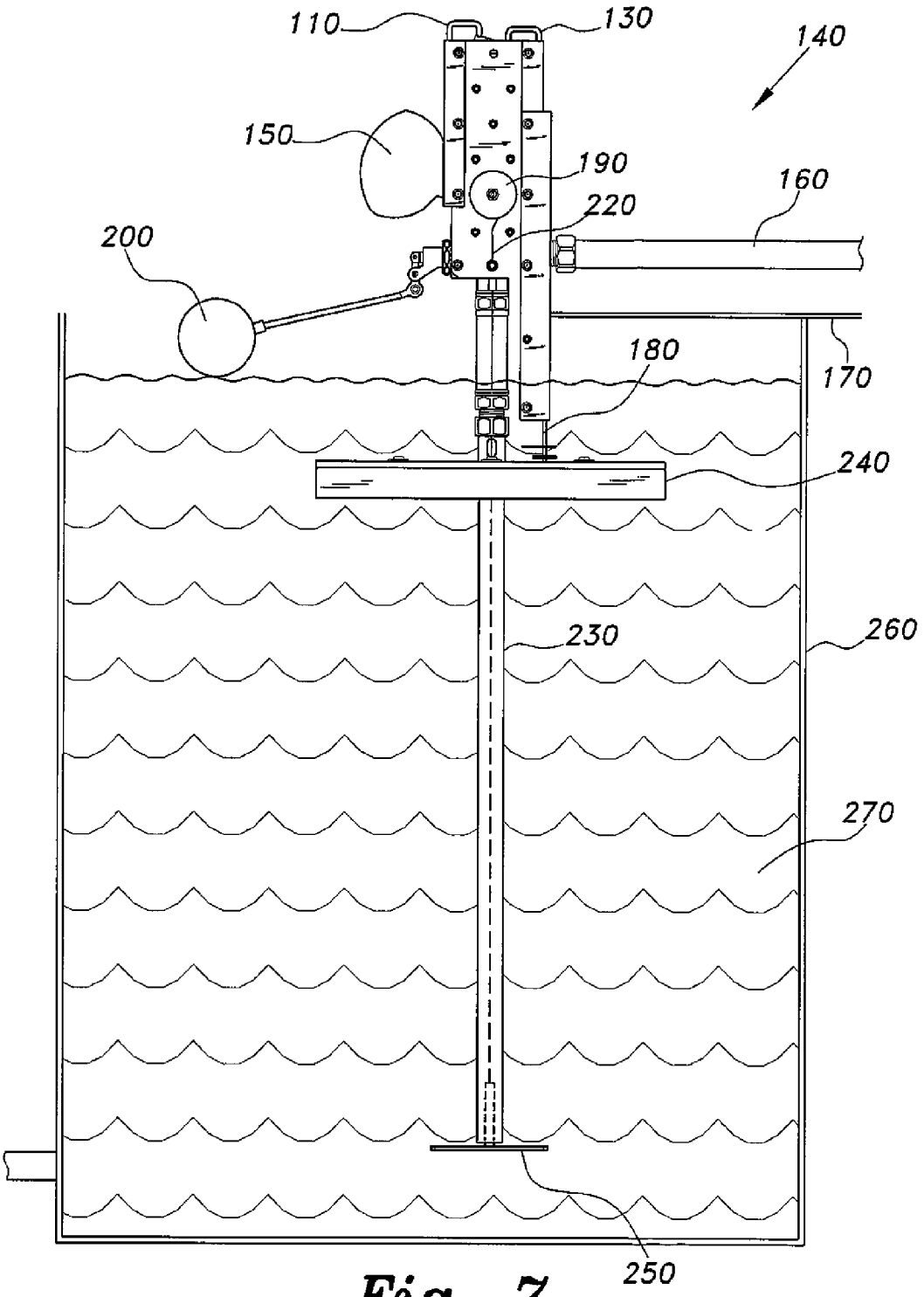
FIG. 7 is an environmental side view of the float-operated pump switch of FIG. 1, showing the tank in an overflow state, the overflow float rising to cut off power to the electric water pump.

A water level control conduit 230 extends downward from an inlet portion of the spigot 210. The water level control conduit 230 extends through the axial center of an annular plastic float 240, the float 240 being hollow and buoyant, allowing the annular float 240 to slide up and down over the water level control conduit 230, acting as the primary float that tracks the water level 270 in the tank 260. As shown in FIGS. 3 and 4, a control cable 220 extends through the water level control conduit 230. A lower portion of the control cable 220 terminates in a planar and rectangular control washer 250. An upper portion of the control cable 220 extends through a bore in an upper portion of the water level control conduit 230 and is spooled onto a take-up spooler 190, which is attached to an eccentric pivoting cam 150 that functions as a power switch actuator. Power switch actuator bars 110 and 130 are looped wire frame members that are slidably disposed in vertically extending channels on opposing sides of the float assembly 140 and selectively energize/de-energize the electric water pump 320. When the water level 270 is at a predetermined low level, the annular primary float 240 slides down the water level control conduit 230 far enough to engage the control washer 250 that, in turn, tensions the control cable 220, causing the spooler 190 to rotate and pivot the power switch actuator cam 150 to swing towards the power switch actuator bar 130. This action ultimately causes the power switch actuator cam 150 to contact the power switch actuator bar 130 causing the power switch actuator bar 130 to slide in a downward motion, exerting a mechanical force on anything in its downward path.

The power switch is a rocker switch 120, which is disposed on the upper portion of the float assembly 140, where the switch actuator bar 110 is positioned to toggle the rocker switch 120 to the OFF position and the switch actuator bar 130 is positioned to toggle the rocker switch 120 to the ON position by exerting a mechanical force on the switch 120 as the actuator bar 110 travels downward due to the downward pivoting motion of the power switch actuator cam 150 while in contact with the actuator bar 110 when the water level 270 in the tank 260 is low.

Conversely, when the water level 270 is rising towards a full tank, the annular float 240 floats upward on the rising water, which causes the annular float 240 to slide upward on the water level control conduit 230 and engage a control pushrod wire frame loop 180. The control pushrod wire frame loop 180 is slidably disposed in channels of the floating assembly on the power switch "ON" side of the assembly, extending upward and leaving a gap between it and bottom portion of the switch actuator bar 130. The bottom portion of the control pushrod wire frame loop 180 includes a pair of circular contact pads for enhanced contact annular float 240. The upper portion of the control pushrod wire frame loop 180 includes a U shaped channel for enhanced contact with the power switch actuator cam 150. When the rising annular float 240 engages the control pushrod wire frame loop 180, the pushrod wire frame loop 180 slides up in the float assembly channels, causing the power switch actuator cam 150 to be pivoted by an upper portion of the pushrod wire frame loop 180 towards contact with the power switch actuator bar 110. When the actuator cam 150 engages the actuator bar 110, the actuator bar 110 slides down to toggle the rocker power switch 120 to the OFF, position thereby turning off the electric water pump 320. A base 170 is provided for attaching the float assembly 140 to the tank 260.

A default "refill needed" water level in the tank is predetermined by the length of the water level control conduit 230. The annular float 240 floats on the water and causes the electric water pump 320 to operate when the water level 270 is lowered to the predetermined level, and turns off the electric water pump 320 when the tank is full. In one particular embodiment, the water level control conduit 230 has a length such that the water pump 320 starts pumping water when the level in the upper tank 260 is one-quarter the volume of the upper tank 260, the water pumping continuing until the upper tank 260 is full, thereby providing a hysteresis and reducing the number of times the water pump needs to be operated.

The overflow float 200 may, for example, be a normally closed electrical switch in series with the rocker power switch 120. Both switches must be closed to turn on the electric water pump 320. If the primary float 240 switch mechanism fails, leaving the rocker power switch 120 stuck in the ON position, and the water level in the tank 260 rises to a predetermined overflow level, the overflow float 200 rises with the water level, opening the overflow switch to turn off the electric water pump 320.

It is to be understood that the present invention is not limited to the embodiments described above, but encompasses any and all embodiments within the scope of the following claims.

I claim:

1. A float-operated pump switch, comprising:

a water tank;

an inlet pipe having a spigot attached thereto, the spigot being disposed over the water tank;

an electric water pump having a water supply pipe connected to the inlet pipe, the electric water pump being adapted for pumping water from a reservoir tank through the supply pipe, the inlet pipe, and the spigot to fill the water tank;

a primary float assembly;

a rocker switch disposed on an upper portion of the float assembly and electrically connected to the electric water pump to selectively energize and de-energize the electric water pump;

first and second power switch actuator bars formed by wire frame looped members slidably disposed on opposing sides of the float assembly, the first power switch actuator bar being operable to energize the electric water pump by selectively engaging an ON position of the rocker switch, the second power switch actuator bar being operable to de-energize the electric water pump by selectively engaging an OFF position of the rocker switch;

a pivoting cam disposed in the float assembly; and an annular float member for floating at water level of water in the water tank, the annular float member being in operable communication with the pivoting cam, causing the pivoting cam to engage the first power switch actuator bar to turn the pump on at a predetermined low water level and to engage the second power switch actuator bar to turn the pump off when the water tank is full.

2. The float-operated pump switch according to claim 1, further comprising an overflow switch connected to the rocker switch and the electric water pump, and an overflow float connected to the overflow switch, the overflow float being adapted to rise with the water level in the tank and open the overflow switch to shut off the electric water pump to prevent overflow of the tank on failure of the rocker switch to shut off the electric pump.

3. The float-operated pump switch according to claim 1, further comprising a base attaching the float assembly to the water tank.

4. The float-operated pump switch according to claim 1, wherein the float assembly further comprises a downward extending water level control conduit, the annular float being slidably disposed on the water level control conduit.

5. The float-operated pump switch according to claim 4, further comprising:

an elongate cable running through the water level control conduit;

a control washer attached to the cable at a lower end of the cable outside of and proximate to a bottom opening of the water level control conduit;

a bore defined in an upper end of the water level control conduit, an upper end of the cable being extending through the bore;

a rotating take-up spooler disposed on the float assembly proximate the bore at the upper end of the water level control conduit, the cable upper end being attached to the take-up spooler and causing the spooler to rotate when the cable is tensioned, the take-up spooler being connected to the pivoting cam and causing the pivoting cam to engage said first power switch actuator bar to turn the water pump on when the cable is tensioned by weight of the annular float member when the water level falls below the bottom end of the water level control conduit.

6. The float-operated pump switch according to claim 5, further comprising a control pushrod wire frame loop slidably disposed in channels defined in the float assembly on the power switch "ON" side of the float assembly, the loop extending upward and defining a gap between the loop and a bottom portion of the first switch actuator bar so that when the annular float member rises as the upper tank is filling, the annular float member engages the control pushrod wire frame loop, the loop sliding upward and contacting the pivoting cam, and causing the cam to pivot towards contact with the second power switch actuator bar to turn the water pump off.

7. The float-operated pump switch according to claim 6, wherein the pivoting cam is eccentric in shape to facilitate swinging movement of the cam towards contact with the second power switch actuator bar when the pushrod wire frame loop imparts pivotal motion to the pivoting cam.

8. The float-operated pump switch according to claim 6, wherein the water level control conduit has a length that causes the pump to start pumping water when the level in the water tank is one-quarter of the volume of the tank, the water pumping continuing until the water tank is full, thereby providing a hysteresis and reducing the number of times the water pump needs to be operated.

* * * * *